US009653794B2

(12) United States Patent
Lin

(10) Patent No.: US 9,653,794 B2
(45) Date of Patent: May 16, 2017

(54) BROADBAND ANTENNA AND WIRELESS COMMUNICATION DEVICE EMPLOYING SAME

(71) Applicant: Chiun Mai Communication Systems, Inc., New Taipei (TW)

(72) Inventor: Yen-Hui Lin, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 156 days.

(21) Appl. No.: 14/464,163

(22) Filed: Aug. 20, 2014

(65) Prior Publication Data

US 2015/0054708 A1 Feb. 26, 2015

(30) Foreign Application Priority Data

Aug. 22, 2013 (CN) ..... 2013 1 0369616

(51) Int. Cl.

| | |
|---|---|
| ***H01Q 1/48*** | (2006.01) |
| ***H01Q 1/50*** | (2006.01) |
| ***H01Q 9/04*** | (2006.01) |
| ***H01Q 5/371*** | (2015.01) |

(52) U.S. Cl.

CPC ..... *H01Q 1/50* (2013.01); *H01Q 1/48* (2013.01); *H01Q 5/371* (2015.01); *H01Q 9/045* (2013.01)

(58) Field of Classification Search

CPC ..... H01Q 1/38; H01Q 1/48; H01Q 9/0421; H01Q 1/243

USPC ..... 343/846, 702, 700 MS, 845

See application file for complete search history.

(56) References Cited

U.S. PATENT DOCUMENTS

| | | | | |
|---|---|---|---|---|
| 8,890,753 | B1 * | 11/2014 | Lee | H01Q 1/243 343/702 |
| 2010/0164835 | A1 * | 7/2010 | Tai | H01Q 1/1207 343/906 |
| 2012/0162038 | A1 * | 6/2012 | Lee | H01Q 5/357 343/749 |
| 2012/0327621 | A1 * | 12/2012 | Rhyu | H01Q 7/00 361/760 |

* cited by examiner

*Primary Examiner* — Dameon E Levi
*Assistant Examiner* — Collin Dawkins
(74) *Attorney, Agent, or Firm* — Steven Reiss

(57) ABSTRACT

A broadband antenna is mounted aside a metal electronic element and includes a feeding portion, a first connecting portion, a second connecting portion, a coupling portion, and a ground portion. The first radiating portion and the second radiating portion are both connected perpendicular to the feeding portion. The coupling portion is spaced from the first radiating portion and the second connecting portion. The ground portion is connected perpendicular to a middle portion of the coupling portion and adjacent to the metal electronic element. These portions cooperatively use a low frequency mode and a high frequency mode. The ground portion increases an inductance performance of the broadband antenna, thereby decreasing interference caused by the metal electronic elements. A wireless communication device employing the broadband antenna is also disclosed.

10 Claims, 5 Drawing Sheets

BROADBAND ANTENNA AND WIRELESS COMMUNICATION DEVICE EMPLOYING SAME

FIELD

The present disclosure relates to a broadband antenna and a wireless communication device employing the broadband antenna.

BACKGROUND

A wireless communication device uses an antenna to transmit and receive wireless signals at different frequencies for different communication systems. The structure of the antenna assembly is complicated and occupies a large space in the wireless communication device. In addition, some other metal electronic elements, such as universal serial bus (USB), battery, electromagnetic shielding, and display, may affect the transmission of the antenna. Therefore, improving broadband antenna performance in the limited space of a wireless device is important, as is decreasing the affect of the surrounding metal electronic elements and insuring optimized transmission of the antenna.

BRIEF DESCRIPTION OF THE DRAWINGS

Many aspects of the disclosure can be better understood with reference to the following figures. The components in the figures are not necessarily drawn to scale, the emphasis instead being placed upon clearly illustrating the principles of the disclosure. Moreover, in the drawings, like reference numerals designate corresponding parts throughout the several views.

DETAILED DESCRIPTION

Figure 1:
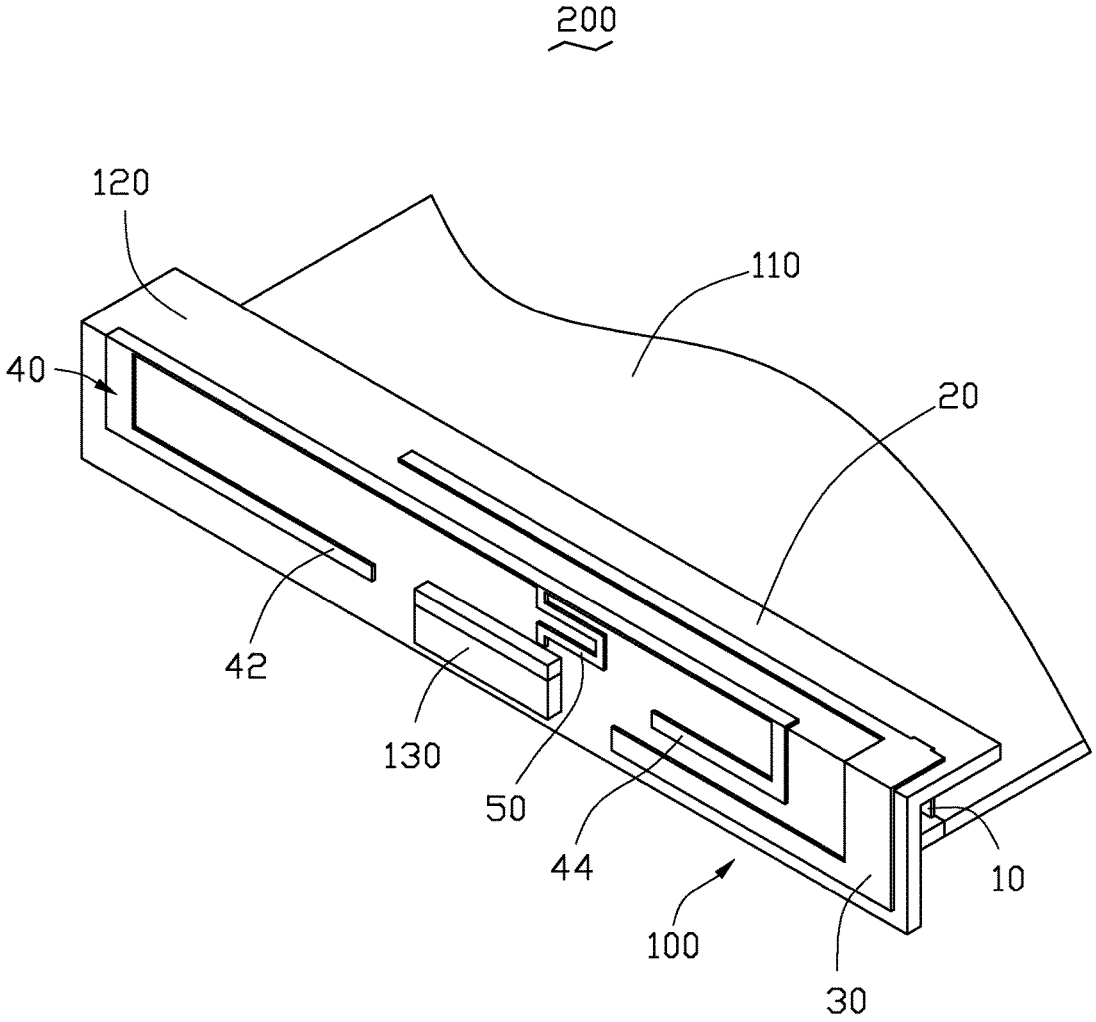
FIG. 1 is an isometric view of an exemplary embodiment of a wireless communication device including a broadband antenna and a carrier.

FIG. 1 illustrates an exemplary embodiment of a wireless communication device 200 employing a broadband antenna 100. The wireless communication device 200 can be a mobile phone or a tablet computer, for example. The wireless communication device 200 further includes a printed circuit board (PCB) 110, a carrier 120, and a universal serial bus (USB) interface 130. The broadband antenna 100 is mounted on the carrier 120 and is electronically connected to the PCB 110. In the exemplary embodiment, the carrier 120 is a housing of the wireless communication device 200. The USB interface 130 is mounted on the PCB 110 and is disposed from the carrier 120, and further is located below the broadband antenna 100.

Figure 2:
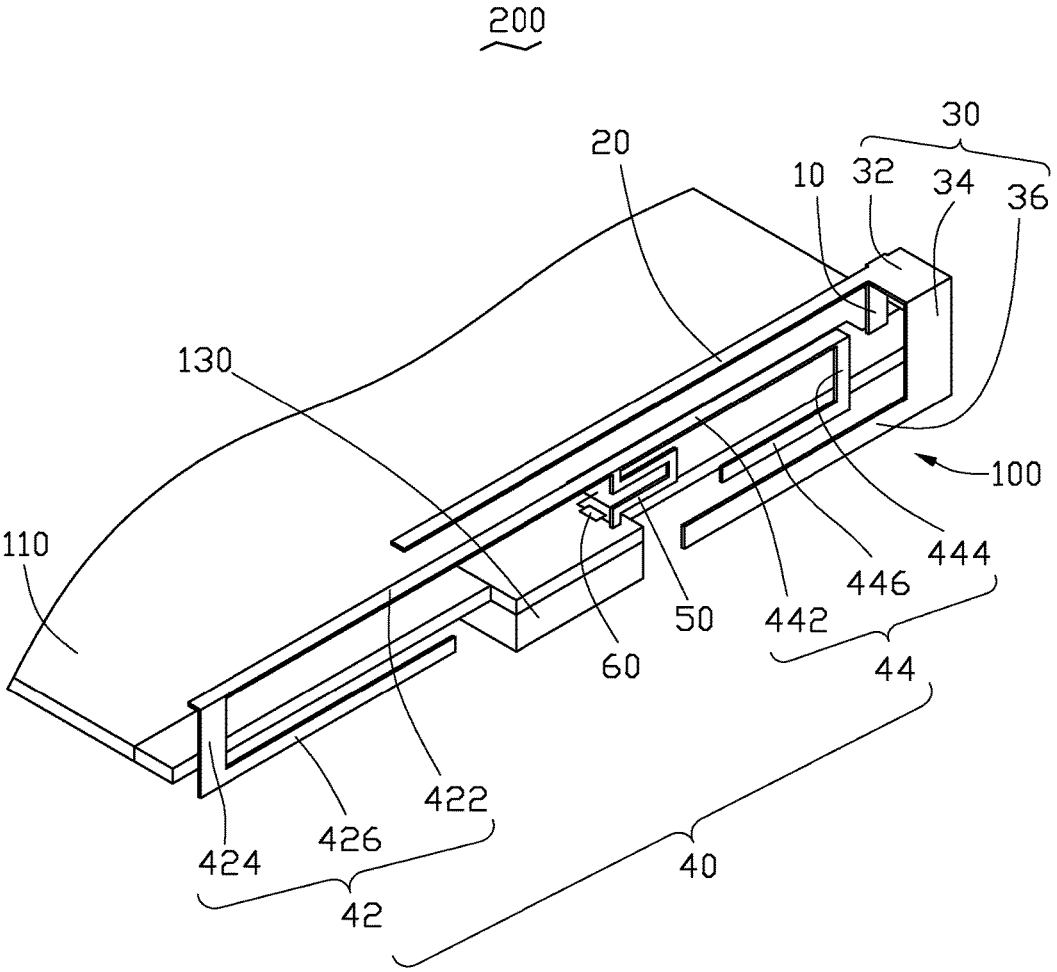
FIG. 2 is similar to FIG. 1, but showing the wireless communication device without the carrier.

FIG. 2 illustrates that the broadband antenna 100 includes a feeding portion 10, a first radiating portion 20, a second radiating portion 30, a coupling portion 40, a ground portion 50, and a matching circuit 60.

The feeding portion 10 is a rectangular sheet and is connected substantially perpendicular to the PCB 110, which is used to feed signals from the PCB 110.

The first radiating portion 20 is a strip sheet and is connected substantially perpendicular to an end of the feeding portion 10 away from the PCB 110. The first radiating portion 20 is parallel with the PCB 110.

The second radiating portion 30 includes a first radiating section 32, a second radiating section 34, and a third radiating section 36 connected in that order. The first radiating section 32 is substantially square sheet and is connected substantially perpendicular to the feeding portion 10 and the first radiating portion 20. The first radiating section 32 is coplanar with the first radiating portion 20. The second radiating section 34 is substantially rectangular sheet and is connected substantially perpendicular to an end of the first radiating section 32 away from the feeding portion 10, and is further parallel with the feeding portion 10. The third radiating section 36 is substantially strip sheet and is connected substantially perpendicular to an end of the second radiating section 34 away from the first radiating section 32, and has a same extending direction with the first radiating portion 20. A gap is formed between the feeding portion 10 and the second radiating section 34, and a width of the gap is equated to a length of the first radiating section 32. The feeding portion 10 feeds signals from the PCB 110 and causes a capacitive coupling effect between the gap, thus transmitting signals from the feeding portion 10, the first radiating section 32, and the second radiating section 34 to the first radiating portion 20 and the third radiating section 36. The first radiating portion 20 and the second radiating portion 30 cooperatively form a monopole antenna to couple the feed signals to the coupling portion 40.

The coupling portion 40 includes a first coupling arm 42 and a second coupling arm 44 connected to and opposite to the first coupling arm 42, which are used for coupling signals from the first radiating portion 20 and the second radiating portion 30. The first coupling arm 42 is substantially U-shaped and includes a first coupling section 422, a second coupling section 424, and a third coupling section 426 connected in that order. The first coupling section 422 is parallel with an end portion of the first radiating portion 20 away from the feeding portion 10. The second coupling section 424 is connected substantially perpendicular to the first coupling section 422. The third coupling section 426 is connected substantially perpendicular to the second coupling section 424 and is parallel with the first coupling section 422. The third coupling section 426 has a shorter length than the first coupling section 422. The second coupling section 424 is coplanar with the third coupling section 426, and one end of the third coupling section 426 is aligned with a side of the USB interface 130.

The second coupling arm 44 is substantially U-shaped and is received between the first radiating portion 20 and the second radiating portion 30. The second coupling arm 44 includes a fourth coupling section 442, a fifth coupling section 444, and a sixth coupling section 446 connected in that order. The fourth coupling section 442 is connected to and is collinear with the first coupling section 422. The fourth coupling section 442 is parallel with the first radiating portion 20. An end of the fourth coupling section 442 away from the first coupling section 422 is spaced from the first radiating section 32. The first coupling section 422, the fourth coupling section 442, the first radiating portion 20, and the first radiating section 32 are coplanar. The fifth coupling section 444 is substantially perpendicular to an end of the fourth coupling section 442 away from the first coupling section 422 and is parallel with the second radiating section 34. The sixth coupling section 446 is substantially perpendicularly to an end of the fifth coupling section 444 away from the fourth coupling section 442 and is parallel with the fourth coupling section 442 and the third radiating section 36. The sixth coupling section 446 has a shorter length than the fourth coupling section 442. The sixth coupling section 446 is coplanar with the fifth coupling section 444 and has an end aligned with another side of the USB interface 130.

The ground portion 50 is substantially serpentine-shaped and is located above the USB interface 130. One end of the ground portion 50 is connected substantially perpendicular to a connecting portion of the first coupling section 422 and the four coupling section 442. The other end of the ground portion 50 is electronically connected to a ground portion of the PCB 110 via the matching circuit 60. The ground portion 50, the second coupling section 424, the third coupling section 426, the fifth coupling section 444, the sixth coupling section 446, the second radiating section 34, and the third radiating section 36 are coplanar.

In an exemplary embodiment, the matching circuit 60 includes a 5.6 nano Henry (nH) inductance element. The serpentine-shaped structure of the ground portion 50 increases an inductance performance of the broadband antenna 100. The ground portion 50 is electronically connected to the matching circuit 60 having the inductance element. Thus, the ground portion 50 and the matching circuit 60 may compensate a capacitance generated by the USB interface 130, thereby decreasing an interference and affection caused by metal electronic elements, such as the USB interface 130, to the broadband antenna 100. The coupling portion 40, the ground portion 50, and the matching circuit 60 cooperatively form a T-type grounded coupling antenna.

Figure 3:
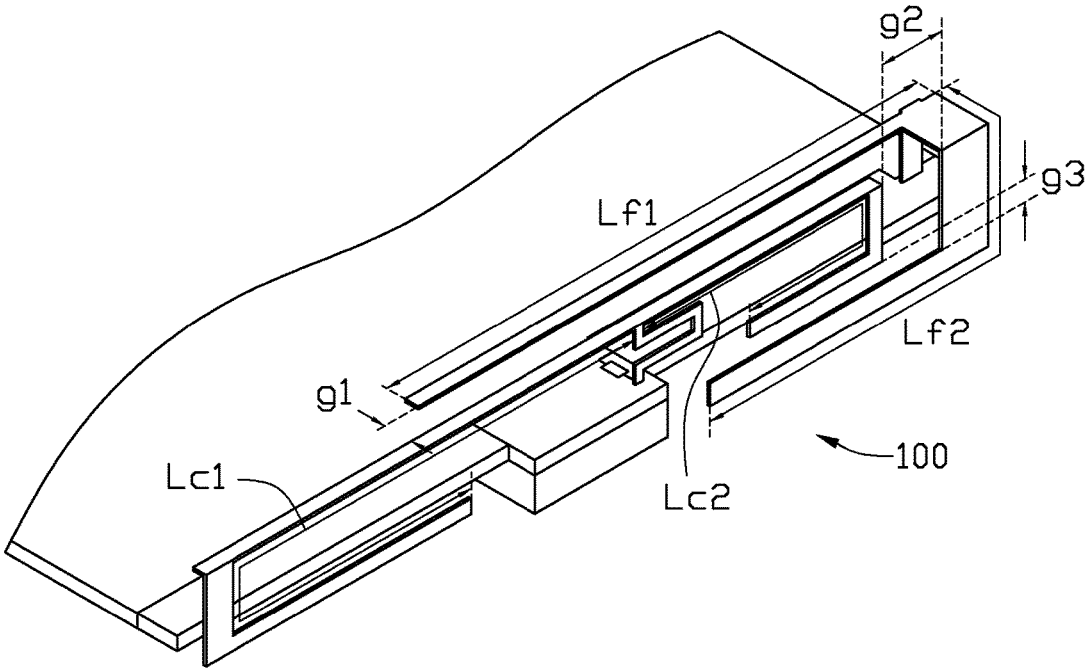
FIG. 3 is a schematic view depicting a relative size of the broadband antenna shown in FIG. 2.

FIG. 3 demonstrates a relative size of the broadband antenna 100. The broadband antenna 100 uses different modes to transmit and receive wireless signals at different frequency bands by adjusting sizes and spaces of the first radiating portion 20, the second radiating portion 30, the coupling portion 40, and the ground portion 50. In the exemplary embodiment, a length of the first radiating portion 20 is represented as Lf1, a length of the second radiating portion 30 is represented as Lf2. A length of the first coupling arm 42 is represented as Lc1, a length of the second coupling arm 44 is represented as Lc2. A width between the first radiating portion 20 and the fourth coupling section 442 is represented as g1, a width between the second radiating section 34 and the fifth coupling section 444 is represented as g2, a width between the third radiating section 36 and the sixth coupling section 446 is represented as g3. In one embodiment, when Lf1=40 millimeter (mm), Lf2=33 mm, Lc1=58 mm, Lc2=33 mm, g1=2 mm, g2=4.5 mm, g3=1.5 mm, the broadband antenna 100 transmits and receives wireless signals at broader frequency bands. The first radiating portion 20, the second radiating portion 30, the first coupling arm 42, and the ground portion 50 use a low frequency mode to transmit and receive low frequency wireless signals. The first radiating portion 20 and the second radiating portion 30 can also establish a high frequency mode to transmit and receive high frequency wireless signals.

Figure 4:
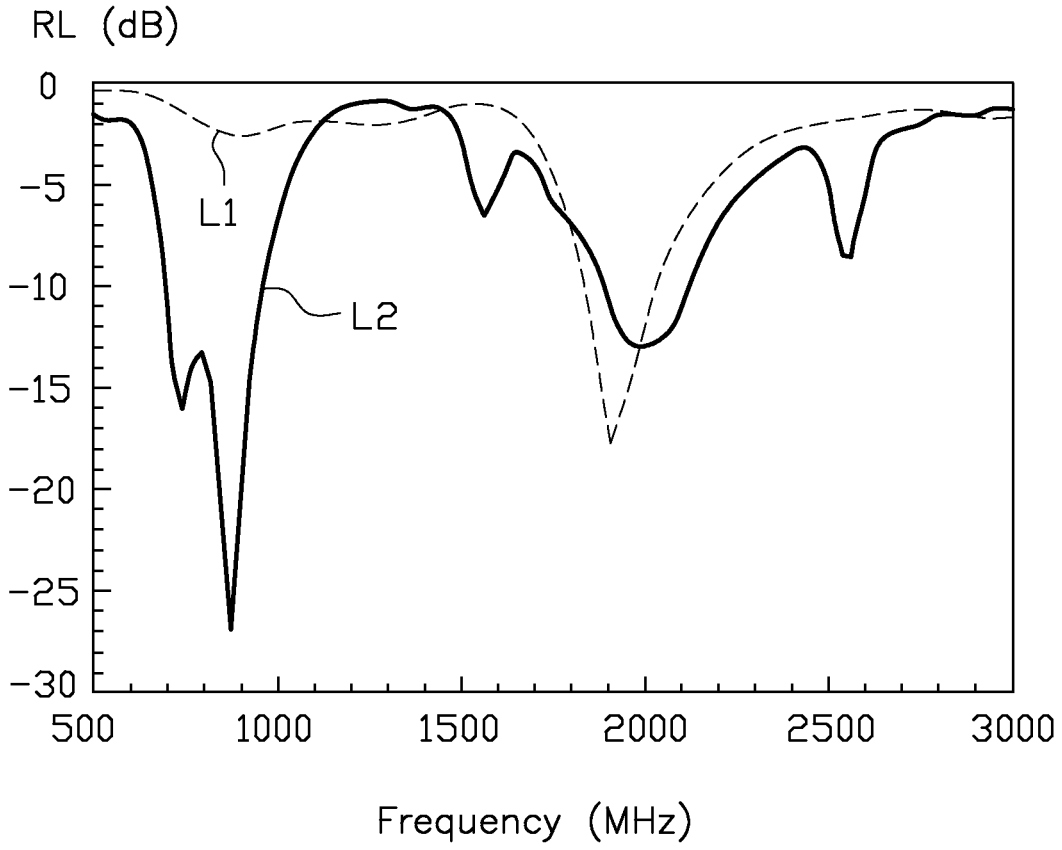
FIG. 4 is a return loss diagram of the broadband antenna shown in FIG. 2.

FIG. 4 illustates a return loss diagram of the broadband antenna 100. A line L1 shows a return loss of an antenna without the coupling portion 40 and the ground portion 50, while a line L2 shows a return loss of the broadband antenna 100 having the coupling portion 40 and the ground portion 50. Shown in FIG. 4, the broadband antenna 100 works at a frequency band of about 700 megaHertz (MHz) to about 960 MHz and a frequency band of about 1710 MHz to about 2170 MHz, which is adapted to a frequency band 13 and a frequency band 17 of a present communication standard. That is, the broadband antenna 100 has a stable working performance to overcome interference when there are metal electronic elements around.

Figure 5:
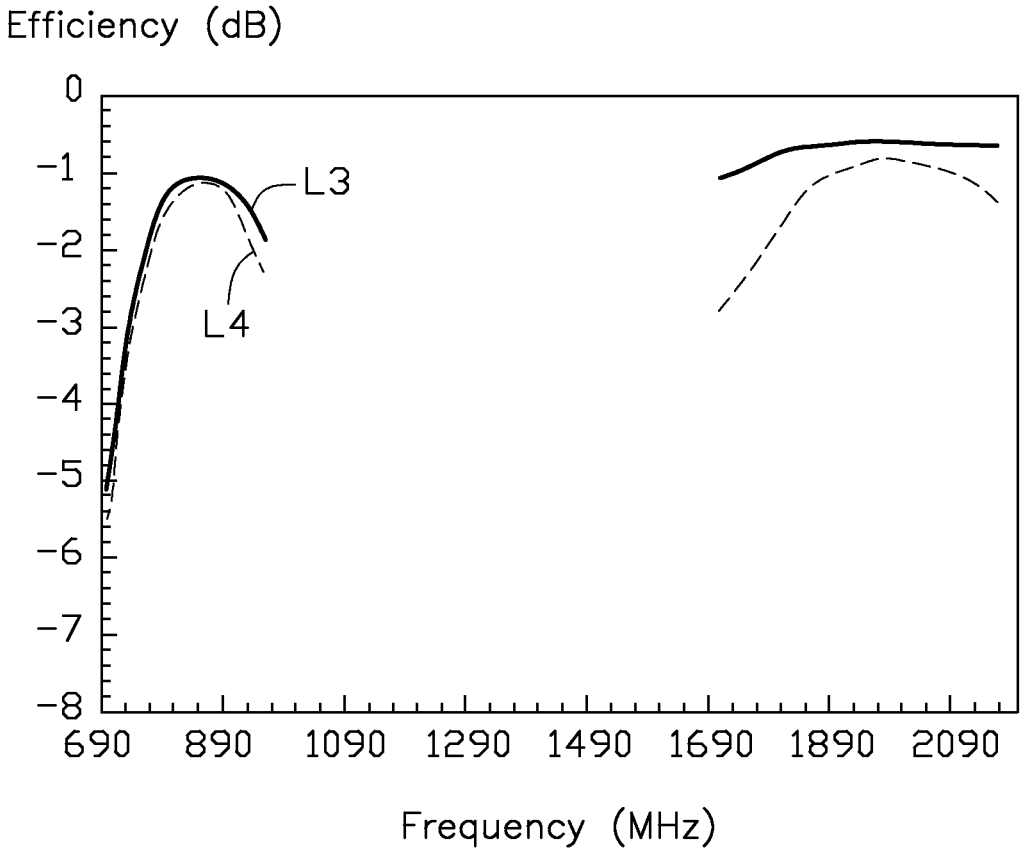
FIG. 5 is a radiating efficiency diagram of the broadband antenna shown in FIG. 2.

FIG. 5 illustrates a radiating efficiency diagram of the broadband antenna 100. A line L3 shows a radiating efficiency of the broadband antenna 100 without considering the return loss, thus showing a whole radiating characteristic of the broadband antenna 100; while a line L4 shows a radiating efficiency of the broadband antenna 100 including the return loss. FIG. 5 shows that the broadband antenna 100 achieves a high radiating efficiency when there are metal electronic elements around.

The broadband antenna 100 has stable working performance by overcoming the interference and negative effects generated by nearby metal electronic elements. Furthermore, in this configuration, the broadband antenna 100 still works at a broad frequency band, thus transmitting and receiving wireless signals at a broad frequency bandwidth, thereby optimizing the radiating performance of the broadband antenna 100.

It is believed that the embodiments and their advantages will be understood from the foregoing description, and it will be apparent that various changes may be made thereto without departing from the scope of the disclosure or sacrificing all of its advantages, the examples hereinbefore described merely being illustrative embodiments of the disclosure.

What is claimed is:

1. A broadband antenna mounted aside a metal electronic element in a wireless communication device, the broadband antenna comprising:

a feeding portion feeding signals;

a first radiating portion connected perpendicular to the feeding portion;

a second radiating portion connected perpendicular to the feeding portion and the first radiating portion;

a coupling portion spaced from the first radiating portion and the second radiating portion, the coupling portion comprising a first coupling arm and a second coupling arm connected to and opposite to the first coupling arm; and a ground portion connected perpendicular to a middle portion of the coupling portion and adjacent to the metal electronic element, the ground portion being substantially serpentine-shape, one end of the ground portion connected perpendicular to a connecting portion of the first coupling arm and the second coupling arm;

wherein the first radiating portion and the second radiating portion feed signals from the feeding portion to cooperatively use a high frequency mode and couple the signals to the coupling portion and the ground portion to cooperatively use a low frequency mode, the ground portion increases an inductance performance of the broadband antenna, thereby decreasing an interference caused by the metal electronic elements;

wherein the second radiating portion comprises a first radiating section, a second radiating section, and a third radiating section connected in that order, the first radiating section is connected perpendicular to and is coplanar with the first radiating portion the, the second radiating section is connected perpendicular to the first radiating section and is parallel with the feeding portion, the third radiating section is connected perpendicular to an end of the second radiating section away from the first radiating section and is parallel with the first radiating portion, the third radiating section has a same extending direction as the first radiating portion;

wherein the first coupling arm and the second coupling arm are both substantially U-shaped;

wherein the first coupling arm comprises a first coupling section, a second coupling section, and a third coupling section, connected in that order, the first coupling section is spaced from and is parallel with an end portion of the first radiating portion away from the feeding portion, the second coupling section is connected perpendicular between the first coupling section and the third coupling section, the third coupling section is parallel with the first coupling section;

wherein the second coupling arm comprises a fourth coupling section, a fifth coupling section, and a sixth coupling section connected in that order, the fourth coupling section is spaced from and is parallel with an end portion of the first radiating portion that near the feeding portion, the fourth coupling section is connected to and is collinear with the first coupling section, the fifth coupling section is connected perpendicular between the fourth coupling section and the sixth coupling section, the fifth coupling section is parallel with the second radiating section, the sixth coupling section is parallel with the third radiating section;

wherein one end of the ground portion is connected perpendicular to a connecting portion of the first coupling section and the fourth coupling section.

2. The broadband antenna as claimed in claim 1, wherein the feeding portion is mounted to a printed circuit board (PCB) of the wireless communication device for feeding signals from the PCB.

3. The broadband antenna as claimed in claim 1, wherein the first radiating portion, the first radiating section, the first coupling section, and the fourth coupling section are coplanar; the second radiating section, the third radiating section, the second coupling section, the third coupling section, the fifth coupling section, the sixth coupling section, and the ground portion are coplanar.

4. The broadband antenna as claimed in claim 1, further comprising a matching circuit, wherein one end of the matching circuit is electronically connected to one end of the ground portion away from the coupling portion, while the other end of the matching circuit is connected to ground.

5. The broadband antenna as claimed in claim 4, wherein the matching circuit comprises an inductance element, thereby increasing an inductance performance of the broadband antenna.

6. A wireless communication device, comprising:

a printed circuit board (PCB);

a metal electronic element mounted on the PCB; and a broadband antenna mounted adjacent to the metal electronic element and electronically connected to the PCB, the broadband antenna comprising:

a feeding portion feeding signals from the PCB;

a first radiating portion connected perpendicular to the feeding portion;

a second radiating portion connected perpendicular to the feeding portion and the first radiating portion;

a coupling portion spaced from and parallel with the first radiating portion and the second radiating portion, the coupling portion comprising a first coupling arm and a second coupling arm connected to and opposite to the first coupling arm; and a ground portion connected perpendicular to a middle portion of the coupling portion and adjacent to the metal electronic element, the ground portion being substantially serpentine-shape, one end of the ground portion connected perpendicular to a connecting portion of the first coupling arm and the second coupling arm;

wherein the first radiating portion and the second radiating portion feed signals from the feeding portion to cooperatively use a high frequency mode and couple the signals to the coupling portion and the ground portion to cooperatively use a low frequency mode, the ground portion increases an inductance performance of the broadband antenna, thereby decreasing an interference caused by the metal electronic elements;

wherein the second radiating portion comprises a first radiating section, a second radiating section, and a third radiating section connected in that order, the first radiating section is connected perpendicular to and is coplanar with the first radiating portion, the second radiating section is connected perpendicular to the first radiating section and is parallel with the feeding portion, the third radiating section is connected perpendicular to an end of the second radiating section away from the first radiating section and is parallel with the first radiation portion, the third radiating section extends in the same direction as the first radiating portion;

wherein the first coupling arm and the second coupling arm are both substantially U-shaped;

wherein the first coupling arm comprises a first coupling section, a second coupling section, and a third coupling section, connected in that order, the first coupling section is spaced from and is parallel with an end portion of the first radiating portion away from the feeding portion, the second coupling section is connected perpendicular between the first coupling section and the third coupling section, the third coupling section is parallel with the first coupling section;

wherein the second coupling arm comprises a fourth coupling section, a fifth coupling section, and a sixth coupling section connected in that order, the fourth coupling section is spaced from and is parallel with an end portion of the first radiating portion near the feeding portion, the fourth coupling section is connected to and is collinear with the first coupling section, the fifth coupling section is connected perpendicular between the fourth coupling section and the sixth coupling section, the fifth coupling section is parallel with the second radiating section, the sixth coupling section is parallel with the third radiating section;

wherein one end of the ground portion is connected perpendicular to a connecting portion of the first coupling section and the fourth coupling section.

7. The wireless communication device as claimed in claim 6, wherein the first radiating portion, the first radiating section, the first coupling section, and the fourth coupling section are coplanar; the second radiating section, the third radiating section, the second coupling section, the third coupling section, the fifth coupling section, the sixth coupling section, and the ground portion are coplanar.

8. The wireless communication device as claimed in claim 6, wherein the broadband antenna further comprises a matching circuit, one end of the matching circuit is electronically connected to one end of the ground portion away from the coupling portion, while the other end of the matching circuit is connected to ground.

9. The wireless communication device as claimed in claim 8, wherein the matching circuit comprises an inductance element, thereby increasing an inductance performance of the broadband antenna.

10. The wireless communication device as claimed in claim 6, wherein the metal electronic device is a USB interface.

* * * * *